US005616392A

United States Patent [19]

Treutwein

[11] Patent Number: 5,616,392

[45] Date of Patent: Apr. 1, 1997

[54] BUFFET PLATTER

[76] Inventor: Georg Treutwein, Säulingstrasse 12, 86825 Bad Wörishofen, Germany

[21] Appl. No.: 403,504

[22] Filed: Mar. 13, 1995

[30] Foreign Application Priority Data

Aug. 18, 1994 [DE] Germany ..... 9413334 U

[51] Int. Cl.[6] ..... B32B 3/02; B65D 1/34

[52] U.S. Cl. ..... 428/80; 220/405; 220/406; 220/407; 220/574; 220/575; 428/156; 428/167; 428/192

[58] Field of Search ..... 428/80, 192, 156, 428/167; 220/575, 574, 405, 406, 407

[56] References Cited

U.S. PATENT DOCUMENTS

Re. 30,962 6/1982 Bridges ..... 220/23.6

3,567,067 3/1971 Weiss ..... 220/71

OTHER PUBLICATIONS

Treutwein, Georg, "Merlin, Das Buffet–System," as discussed on p. 1 of the patent specifications.

*Primary Examiner*—Nasser Ahmad
*Attorney, Agent, or Firm*—Hickman Beyer & Weaver

[57] ABSTRACT

A buffet platter with a plastic frame for maintaining the space between buffet platters stacked on each other has a smooth-surfaced, preferably mirrored, food-carrying plate at the upper side is surrounded by the plastic frame, which is profiled at the outer edge to engage with a buffet platter of the same design stacked thereon, in order to prevent sideways slipping. The plastic frame is formed in one piece and the food-carrying plate is supported on a base surface of the plastic frame that is formed in one piece with the plastics frame.

20 Claims, 2 Drawing Sheets

BUFFET PLATTER

CROSS REFERENCE TO RELATED APPLICATIONS

The present application claims priority under the International Convention of German Utility Model Application No. G 94 13 334.4, filed Aug. 18, 1994, the disclosure of which is incorporated herein by reference for all purposes.

BACKGROUND OF THE INVENTION

1. Field of the Invention

The present invention relates generally to buffet platters, and more particularly to stackable buffet platters.

2. Description of the Prior Art

Buffet platters for making up buffet meals are in common use in the catering trade, the known buffet planers consisting of a six or more sided plastic frame, which is assembled from six or more identical individual segments. These individual segments are screwed together, hidden on the inside. A mirror about four millimeters thick is clamped in the frame made up from the individual segments, a groove being cut in the inner side of the individual frame segments, in which groove the mirror is fitted and clamped by the screwing together of the individual segments. The upper and lower edges of these individual segments are so profiled that they prevent sideways slipping when stacking one on the other. These plastics frames have a frame height of about ten centimeters, so that the buffet platters can be stacked even with food served up on the mirror. However this construction has several disadvantages.

Firstly, relative expensive manufacture results from the multi-part design with the individual segments, since the screw connections have to be made separately in the frame, which leads to substantial additional expense, especially with twelve or sixteen sided designs. Moreover round or oval basic shapes of the buffet platter can hardly be produced in this way. Secondly, a relatively small torsional strength results from the screwed construction, so that the clamped-in mirror can easily break with stronger one-sided loading. In addition, the mirror of the glass plate must be made as a food-carrying plate with a relatively large wall thickness, in order to be able to carry the served up food and provide sufficient stiffness even with twisting. However, this makes the buffet platter relatively heavy and thus awkward to handle. Furthermore, a particular disadvantage is that, because of the mirror clamped in the individual segments, juices or marinades can run into the clamping groove from the served up food, so that, for reasons of hygiene, the buffet platter has to be completely disassembled and thoroughly cleaned after practically every serving.

SUMMARY OF THE INVENTION

The present invention avoids the aforementioned disadvantages of the prior art with a buffet platter that is simple to make, is light in weight, and which is highly stable during use.

Particularly simple manufacture results from the formation of the buffet platter in one piece, since its plastics frame can preferably be made as a deep drawn part in one working step. Thus, the manufacture of screw bores, threaded bushes and assembly of the individual segments are no longer necessary. In addition, this buffet platter has enhanced stability on account of the one-piece structure, so that the wall thickness can also be reduced and the overall weight of the buffet platter be reduced. A particular advantage is that the food-carrying plate is supported by a base surface formed in one piece with the plastics frame. This firstly results in additional stiffening of the plastics frame and secondly provides direct support for the food-carrying plate, so that this mirror or glass plate can also be made with a very small wail thickness. The wall strength or thickness of the food-carrying plate can even be reduced to a foil thickness, since the smooth surface is supported by the base surface. This results in further reduction of the total weight of the buffet planer, so that in all very good handiness is obtained. It is further of particular advantage that the food-carrying plate no longer has to be clamped in the plastics frame, because of the continuous support on the base surface, but can be placed directly on the frame, whereby the grooves at the edge of the buffet platter which demand so much cleaning are avoided.

It is further advantageous that, on account of the small wall thickness of the plastics frame, provision of a parking edge by the raised profiling of the plastics frame cooperating with the lower edge of the buffet platter stacked thereon, gives security against sideways slipping, without the underside having to have additional profiling worked thereon. This results in reliable centring of the buffet platters stacked on top of each other, so that relatively high stacks can be made up for serving or catering purposes.

BRIEF DESCRIPTION OF THE DRAWINGS

An embodiment of the buffet platter will now be described in more detail and explained with reference to the drawings, in which.

DESCRIPTION OF THE PREFERRED EMBODIMENTS

Figure 1:
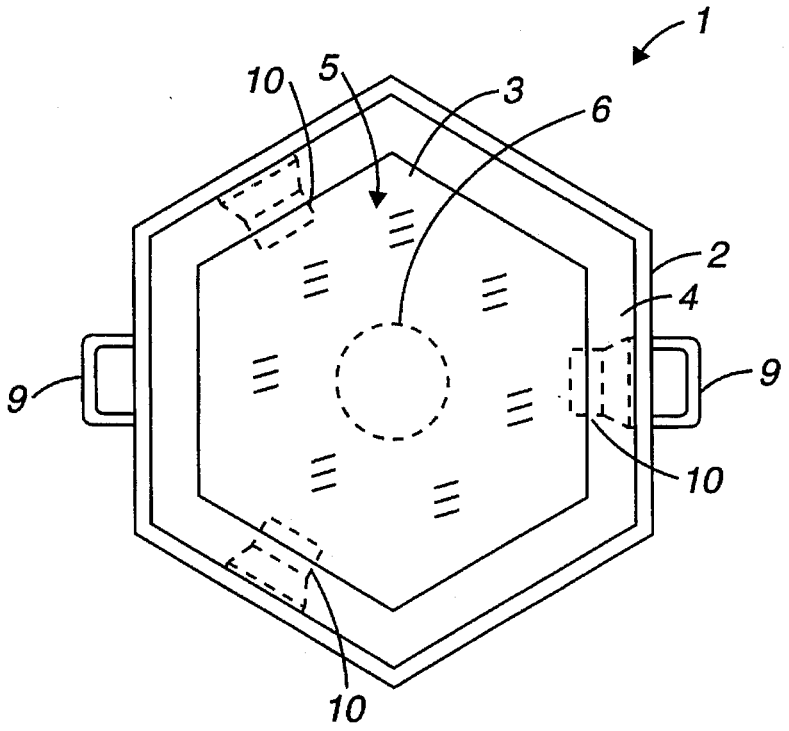
FIG. 1 is a plan view of a buffet platter with a six-sided basic shape.

A buffet platter 1 is shown in FIG. 1, with a six-sided basic shape, the buffet platter 1 being formed essentially by a likewise six-sided plastics frame 2 and a food-carrying plate 3 placed thereon for serving foodstuffs. There is a raised profiling 4 surrounding the outer edge of the plastics frame 2, so that when placing several buffet platters 1 one on top of the other (cf. FIG. 2), the profiling 4 is engaged by the respective bottom edge la of the buffet platter 1, wherein a narrow parking edge 4*a* of the plastics frame 2 is provided adjacent the surrounding profiling 4 as a transition to the outer periphery of the plastics frame 2, on which edge 4*a* the bottom edge 1*a* bears.

In accordance with the novelty, the plastics frame 2 of the buffet platter 1 is provided with a base surface 5, on which the food-carrying plate 3, preferably a mirrored glass plate, lies and is thus supported. The plastics frame 2 is preferably formed from a plastics plate as a deep drawn part, so that the shape shown in half section in FIG. 2 results. It is important that arbitrary shapes, for example semicircular or oval shapes can be formed in a simple way by suitable design of the deep drawing tool, because of the formation of the plastics frame 2 in one piece. The food-carrying plate 3 is at least for the most part supported by the base surface 5, this base surface 5 being reined continuously in general. However openings 6, recesses and/or hollows can be formed or pressed in the base surface 5 in the deep drawing operation, so that there is a further reduction in weight and an increase in the stiffness of form of the plastics frame 2. It should be noted that, in contrast to the known buffet platter with a plastics frame consisting of a plurality of individual segments, each side is connected through the base surface 5 to the opposed side of the plastics frame 2 by virtue of the one-piece design of the plastics frame 2, so that a construction which is particularly torsionally stiff results. Handles 9 or gripping recesses can be formed directly on the plastics frame 2, so that the buffet platter 1 can be carried easily.

Figure 2:
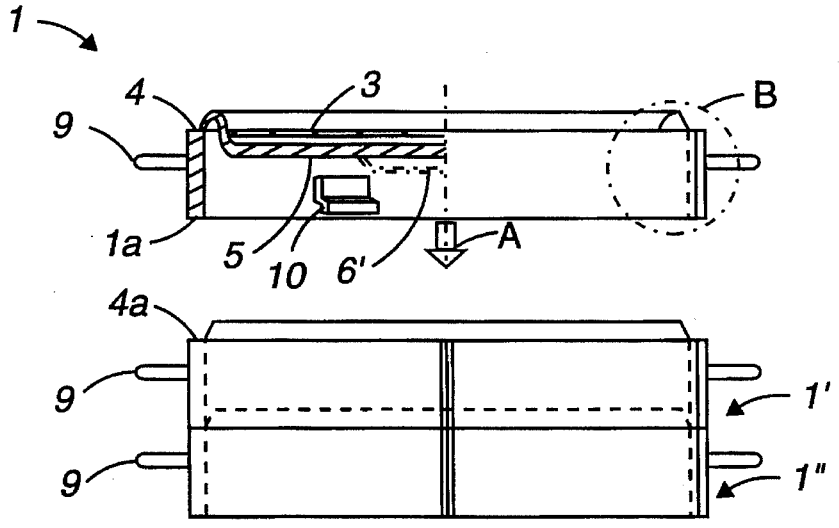
FIG. 2 is a side view of the buffet platter according to FIG. 1 in half section, with a schematic representation of stacking.

The buffet platter 1 according to FIG. 1 is shown in half section in FIG. 2, from which the direct bearing and wide-area support of the food-carrying plate 3 by the base surface 5 is in particular apparent. It should be mentioned that, on account of this support by means of the base surface 5, the food-carrying plate 3 can be made relatively thin and can even only have a wall thickness like that of a foil. The food-carrying plate 3 can also be in the form of a transparent glass plate, so that the base surface 5 can also serve as a display plate by virtue of its recessed form, for example through a hollow 6' shown in broken lines, in which hollow 6' decorations, for example flowers, can be placed. The hollow 6' can also be accessible by a drawer or a screw cover. Partial silvering of the food-carrying plate 3 is also possible, in which the annular region of the food-carrying plate 3 which lies on the base surface 5 is silvered, while the central region over the, hollow 6' or the opening 6 is transparent, in order to leave the view clear to the decoration or a business logo.

Figure 3:
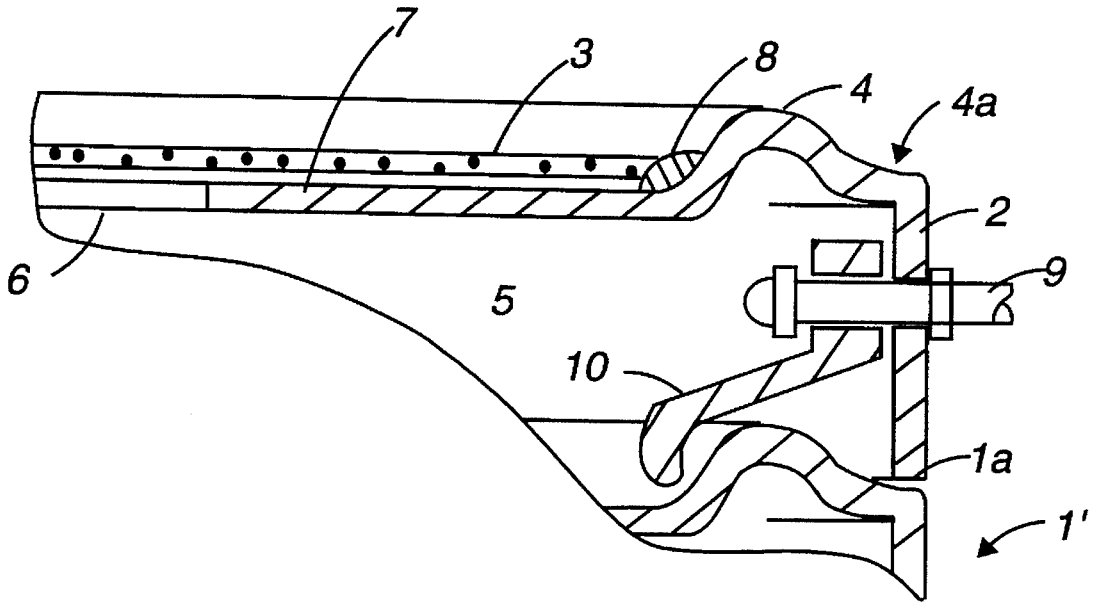
FIG. 3 shows an enlarged edge region of the buffet platter according to FIG. 2.

In order to increase the sideways security against slipping with a plurality of buffet platters 1, 1', 1", etc. stacked on each other as shown in FIG. 2, plurality of clips 10 can be provided on the inner periphery of the plastics frame 2, having an offset part engaging the profiling 4 of the buffet platter 1' stacked thereunder from the inside. Thus, in addition to the engagement of the lower edge 1*a* with the profiling 4 from the outside, there is a further engagement from the inside, as is shown especially in FIG. 3 in an enlargement of the corner region B. It should be mentioned that these clips could be stuck on to the inner periphery of the plastics frame 2 but also in implementation with only two clips 10, they can be screwed on at the same time as the handles 9, as is shown in FIG. 3. As can be seen from FIG. 2, when the buffet platter 1 is placed on the buffet platter 1' stacked thereunder, the lower edge 1*a* engages the profiling 4 from the outside and the clips 10 engage the profiling 4 from the inside, so that a particularly stable stack results from stacking a plurality of buffet platters in accordance with the arrow A. As is further apparent, by stacking a plurality of buffet platters 1, 1', 1", etc. on one another, a hollow space is created in each case, so that prepared meals can be kept dust-tight and be transported.

The region B indicated by a circle in FIG. 2 is shown enlarged and in cross section in FIG. 3. From this can be seen in particular the relatively thin-walled design of the plastics frame 2, the raised form of the profiling 4 and the support of the food-carrying plate 3 by the base surface 5, In order to increase the stiffness of the shape, raised parts 7 in the form of webs, ribs or pips can also be provided on the base surface 5, which also results in the food-carrying plate 3 resting at points. In order to reduce the weight, stamped out pans or openings 6 can be provided in the base surface 5, without the load-beating capacity of the base surface 5 being substantially reduced. The food-carrying plate 3 is stuck on to the base surface 5 in order to fix it inside the plastics frame 2, preferably by spot application of adhesive, as is known in fixng tiles for example. The gap resulting at the edge region of the food-carrying plate 3 relative to the plastics frame 2 and its profiling 4 is filled with a jointing material 8 impervious to foodstuffs, in order to avoid leakage of food juices, sauces and the like here, as well as to facilitate cleaning. Irregularities in the cutting of the food-carrying plate by the glassworks can also be compensated for by this jointing material 8, preferably a silicone, so that, in contrast to the known buffet platter the food-carrying plate 3 does not have to be cut particularly accurately out of mirror glass.

In the side region of FIG. 3 there is moreover shown the fixing of the handle 9, in which its yoke is merely stuck through the plastics frame 2 and screwed up by a cap nut. The offset clips 10 can be fixed at the same time by means of aligned bores. The underside of the clips 10 then fits from the inside round the profiling 4 of the next buffet platter thereunder in the superimposed state. In general two or three such clips 10 suffice for this additional security against slipping by internal engagement, as is shown for example in FIG. 1 in hidden, broken lines.

Although a six-sided buffet platter 1 is here shown in FIGS. 1 and 2, the plastics frame 2 and correspondingly the food-carrying plate 3 can have any arbitrary basic shape, especially a circular or oval shape, as is often desired for buffet serving of dishes. Six, eight or twelve-sided shapes can also be made simply. After making the one-piece plastics frame 2 by forming of a unitary plastics sheet, preferably by deep drawing a unitary or one-piece plastics plate, the food-carrying plate 3 is cut according to the basic shape of the plastics frame 2 and laid on the base surface 5 and stuck on. It is important that the food-carrying plate 3 is held without stress within the plastics frame 2 and is no longer clamped in, in contrast to the state of the art. This reduces the danger of breakage substantially, since there are not stresses in the food-carrying plate 3. Because of this the novel buffet platter 1 can even drop from small heights without breaking. Furthermore the food-carrying plate 3 can also consist of very thin glass or even of mirrored metal foil or an electro-deposited metal layer, since the support function is taken over by the base surface 5. This results in a substantial saving in weight and thus easier handling in transport and in making up the buffet.

While this invention has been described in terms of several preferred embodiments, it is contemplated that alterations, permutations, and equivalents thereof will become apparent to those skilled in the art after studying preceding descriptions and the drawing. It is therefore intended that the following appended claims be interpreted to include all such alterations, permutations, and equivalents as fall within the true spirit and scope of the present invention.

I claim:

1. A buffet platter comprising:

a one-piece thin-walled unitary plastic frame including a base surface, an outer edge, and an outer periphery extending downwardly from said outer edge and terminating in a bottom edge, said frame being torsionally stiff whereby said frame is sufficiently rigid to be self supporting during use, said frame being profiled at said outer edge to engage with a bottom edge of a buffet platter of the same design that may be stacked thereon, in order to prevent sideways slipping of such a buffet platter of the same design; and a separate reflective food-carrying plate supported on said base surface.

2. A buffet platter according to claim 1, wherein the thin-walled unitary plastic frame is made as a deep drawn part from a plastic material.

3. A buffet platter according to claim 1, wherein the base surface is formed as a continuous, flat surface.

4. A buffet platter according to claim 1, wherein the base surface has one or more openings.

5. A buffet platter according to claim 1, wherein the food-carrying plate is stuck to the base surface.

6. A buffet platter according to claim 1, wherein said base surface has rib-formed raised parts located on said base surface away from said outer edge.

7. A buffet platter according to claim 1, wherein handles are provided on the outer periphery of the thin-walled unitary plastic frame.

8. A buffet platter according to claim 1, wherein clips are arranged on an inner periphery of the thin-walled unitary plastic frame and engage over a profiled outer edge of a buffet platter stacked thereunder.

9. A buffet platter according to claim 1, wherein a gap between said thin-walled unitary plastic frame and a periphery of said food-carrying plate is filled with a jointing material.

10. A buffet platter according to claim 1, wherein the food-carrying plate is formed by a mirrored glass plate.

11. A buffet platter according to claim 1, wherein the thin-walled unitary plastic frame has a four or six-sided basic shape.

12. A buffet platter according to claim 1, wherein the thin-walled unitary plastic frame has a circular or oval basic shape.

13. A buffet platter comprising:

a one-piece plastic frame including a base surface having rib-formed raised parts, an outer edge, and an outer periphery extending downwardly from said outer edge and terminating in a bottom edge, said frame being profiled at said outer edge to engage with a bottom edge of a buffet platter of the same design that is stacked thereon, in order to prevent sideways slipping, said rib-formed raised parts located on said base surface away from said outer edge; and a separate food-carrying plate supported on said base surface.

14. A buffet platter comprising:

a one-piece plastic frame including a base surface, a profiled outer edge, and an outer periphery extending downwardly from said outer edge and terminating in a bottom edge, said frame being profiled at said outer edge to engage with a bottom edge of a buffet platter of the same design that is stacked thereon, in order to prevent sideways slipping;

clips arranged on an inner periphery of said frame that are adapted to engage said profiled outer edge of another frame of a similar construction that may be stacked beneath said frame; and a separate food-carrying plate supported on said base surface.

15. A buffet platter comprising:

a one-piece plastic frame including a base surface, an outer edge, and an outer periphery extending downwardly from said outer edge and terminating in a bottom edge, said frame being profiled at said outer edge to engage with a bottom edge of a buffet platter of the same design that is stacked thereon, in order to prevent sideways slipping; and a separate food-carrying plate supported on said base surface, wherein a gap formed between said frame and a periphery of said food-carrying plate is filled with a jointing material.

16. A buffet platter comprising:

a one-piece plastic frame including a base surface, an outer edge, and an outer periphery extending downwardly from said outer edge and terminating in a bottom edge, said frame being profiled at said outer edge to engage with a bottom edge of a buffet platter of the same design that is stacked thereon, in order to prevent sideways slipping; and a separate food-carrying, mirrored glass plate supported on said base surface.

17. A buffet platter according to claim 16, wherein said base surface has rib-formed raised parts, said rib-formed raised parts located on said base surface away from said outer edge.

18. A buffet platter according to claim 16, wherein clips are arranged on an inner periphery of said unitary plastic frame and are adapted to engage a profiled outer edge of a buffet platter of similar design that may be stacked thereunder.

19. A buffet platter according to claim 16, wherein a gap between said unitary plastic frame and a periphery of said food-carrying plate is filled with a jointing material.

20. A buffet platter according to claim 16, wherein said unitary plastic frame is made as a deep drawn part from a plastic material.

* * * * *